US011107312B2

(12) United States Patent
Ono

(10) Patent No.: US 11,107,312 B2
(45) **Date of Patent: *Aug. 31, 2021**

(54) GAMING MACHINE, CONTROL METHOD FOR MACHINE, AND PROGRAM FOR GAMING MACHINE

(71) Applicant: Konami Gaming, Inc., Las Vegas, NV (US)

(72) Inventor: Yuji Ono, Zama (JP)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/728,380

(22) Filed: Dec. 27, 2019

(65) Prior Publication Data

US 2020/0380815 A1 Dec. 3, 2020

Related U.S. Application Data

(63) Continuation of application No. 15/646,542, filed on Jul. 11, 2017, now Pat. No. 10,553,066.

(51) Int. Cl.
*G07F 17/32* (2006.01)

(52) U.S. Cl.
CPC ..... *G07F 17/3209* (2013.01); *G07F 17/3211* (2013.01); *G07F 17/3223* (2013.01)

(58) Field of Classification Search
CPC .. G07F 17/34; G07F 17/3213; G07F 17/3265; G07F 17/3267
See application file for complete search history.

(56) References Cited

U.S. PATENT DOCUMENTS

| | | | | |
|---|---|---|---|---|
| 9,208,655 | B2 | 12/2015 | Aida et al. | |
| 9,478,107 | B2 * | 10/2016 | Nakamura | G07F 17/3213 |
| 9,959,703 | B2 | 5/2018 | Igesund | |
| 2004/0012145 | A1 | 1/2004 | Inoue | |
| 2006/0058097 | A1 | 3/2006 | Berman et al. | |
| 2006/0183534 | A1 | 8/2006 | Yoshimi | |
| 2007/0105611 | A1 | 5/2007 | O'Halloran | |
| 2010/0124969 | A1 | 5/2010 | Hughes et al. | |
| 2010/0190543 | A1 * | 7/2010 | Englman | G07F 17/34 463/20 |
| 2012/0122532 | A1 | 5/2012 | Berman et al. | |
| 2014/0066172 | A1 * | 3/2014 | Nakamura | G07F 17/3265 463/20 |

(Continued)

*Primary Examiner* — Seng H Lim
(74) *Attorney, Agent, or Firm* — Howard & Howard Attorneys PLLC

(57) ABSTRACT

A gaming machine provides an operation unit, a display unit, and a control unit. The display unit displays a display area with a plurality of cells in a grid. A respective symbol, from a set of symbols, is displayed in each cell. The symbols in the set of symbols having a ranking from lowest to highest and include first and second sub-groups. The symbols in the second sub-group of symbols have a higher ranking than the symbols in the first sub-group. The control unit randomly selects one of the symbols from the second sub-group of symbols. The selected symbols from the second sub-group of symbols and the first sub-group of symbols forming an instant sub-group of symbols. The control unit being further configured to randomly select a plurality of symbols associated with the display area from the instant sub-group of symbols.

20 Claims, 15 Drawing Sheets

(56) References Cited

U.S. PATENT DOCUMENTS

| | | | |
|---|---|---|---|
| 2014/0187309 | A1 | 7/2014 | Trainor et al. |
| 2015/0087385 | A1 | 3/2015 | Shiraishi et al. |
| 2015/0126264 | A1 | 5/2015 | Igesund |
| 2015/0248810 | A1 | 9/2015 | Wortmann et al. |
| 2015/0248811 | A1 | 9/2015 | Wortmann et al. |
| 2016/0086425 | A1 | 3/2016 | Shiraishi |
| 2016/0086427 | A1 | 3/2016 | Nakamura |
| 2016/0086428 | A1 | 3/2016 | Nakamura |
| 2016/0351005 | A1 | 12/2016 | Igesund |
| 2016/0351006 | A1 | 12/2016 | Igesund |
| 2017/0213416 | A1 | 7/2017 | Wortmann |
| 2017/0236383 | A1 | 8/2017 | Nakamura |

* cited by examiner

GAMING MACHINE, CONTROL METHOD FOR MACHINE, AND PROGRAM FOR GAMING MACHINE

CROSS REFERENCE TO RELATED APPLICATIONS

This application is a continuation of U.S. patent application Ser. No. 15/646,542, filed Jul. 11, 2017, the disclosure of which is hereby incorporated by reference in its entirety.

TECHNICAL FIELD

The present invention relates to a gaming machine, a control method for a gaming machine, and a program for a gaming machine.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

SUMMARY OF INVENTION

In one aspect of the present invention, a gaming machine is provided. The gaming machine includes an operation unit, a display unit, and a control unit. The display unit is configured to display a display area. The display area includes a plurality of cells arranged in a grid and being configured to display a respective symbol in each cell. The symbol displayed in each cell is from a set of symbols. The symbols in the set of symbols have a ranking from lowest to highest. The set of symbols includes a first sub-group of symbols and a second sub-group of symbols. The symbols in the second sub-group of symbols have a higher ranking than all of the symbols in the first sub-group. The control unit is operably coupled to the operation unit and the display unit and is configured to allow a player to establish a wager and to provide a game in response to player operation. The control unit, in providing the game, is configured to: randomly select one of the symbols from the second sub-group of symbols, the selected symbol from the second sub-group of symbols and the first sub-group of symbols forming an instant sub-group of symbols; randomly select a plurality of symbols associated with the display area from the instant sub-group of symbols, each symbol in the plurality of symbols being associated with one of the plurality of cells in the grid, the plurality of symbols forming an outcome of the game; and, provide an award to the player as a function of the outcome of the game and a pay table.

In another aspect of the present invention, a control method for providing a game to a player using a gaming machine is provided. The gaming machine includes an operation unit, a display unit, and a control unit. The display unit is configured to display a display area. The display area includes a plurality of cells arranged in a grid and being configured to display a respective symbol in each cell. The symbol displayed in each cell is from a set of symbols. The symbols in the set of symbols have a ranking from lowest to highest. The set of symbols includes a first sub-group of symbols and a second sub-group of symbols. The symbols in the second sub-group of symbols have a higher ranking than all of the symbols in the first sub-group. The control unit is operably coupled to the operation unit and the display unit and provides a game in response to player operation. The control unit, in providing the game, performs the steps of: allowing the player to make a wager; randomly selecting one of the symbols from the second sub-group of symbols, the selected symbol from the second sub-group of symbols and the first sub-group of symbols forming an instant sub-group of symbols; randomly selecting a plurality of symbols associated with the display area from the instant sub-group of symbols, each symbol in the plurality of symbols being associated with one of the plurality of cells in the grid, the plurality of symbols forming an outcome of the game; and, providing an award to the player as a function of the outcome of the game and a pay table.

In still another aspect of the present invention, a program for a gaming machine provides a game to a player. The gaming machine includes an operation unit, a display unit, and a control unit. The display unit is configured to display a display area. The display area includes a plurality of cells arranged in a grid and being configured to display a respective symbol in each cell. The symbol displayed in each cell is from a set of symbols. The symbols in the set of symbols have a ranking from lowest to highest. The set of symbols includes a first sub-group of symbols and a second sub-group of symbols. The symbols in the second sub-group of symbols have a higher ranking than all of the symbols in the first sub-group. The program, in providing the game, performing the steps of: allowing the player to make a wager; randomly selecting one of the symbols from the second sub-group of symbols, the selected symbol from the second sub-group of symbols and the first sub-group of symbols forming an instant sub-group of symbols; randomly selecting a plurality of symbols associated with the display area from the instant sub-group of symbols, each symbol in the plurality of symbols being associated with one of the plurality of cells in the grid, the plurality of symbols forming an outcome of the game; and, providing an award to the player as a function of the outcome of the game and a pay table.

DETAILED DESCRIPTION OF EMBODIMENTS

A gaming machine, according to an embodiment of the present invention, referencing the attached figures is described in detail below. Further, duplicated descriptions will be omitted for identical attached symbols in identical or corresponding parts in each figure.

With reference to the drawings, and in operation, the present invention is directed towards a gaming machine, a control method for a gaming machine, and a program for a gaming machine that provides a game to a player. In one embodiment, the game may include a primary game and one or more feature(s) and/or bonus game(s). The primary game utilizes a set of symbols. During the primary game, symbols are selected from a set of symbols and displayed. The symbols in the set of symbols have a ranking from lowest to highest and form a first sub-group of symbols and a second sub-group of symbols. The symbols in the second sub-group of symbols have a higher ranking than the symbols in the first sub-group of symbols. One of the symbols from the second sub-group of symbols is randomly selected. The randomly selected symbols from the second sub-group of symbols and the first sub-group of symbols form an instant sub-group of symbols. A plurality of symbols is randomly selected from the instant sub-group of symbols and form an outcome of the primary game. The primary game is discussed in more detail below. In general, outcomes based on a higher ranking symbol has a higher or greater potential award.

Figure 1A:
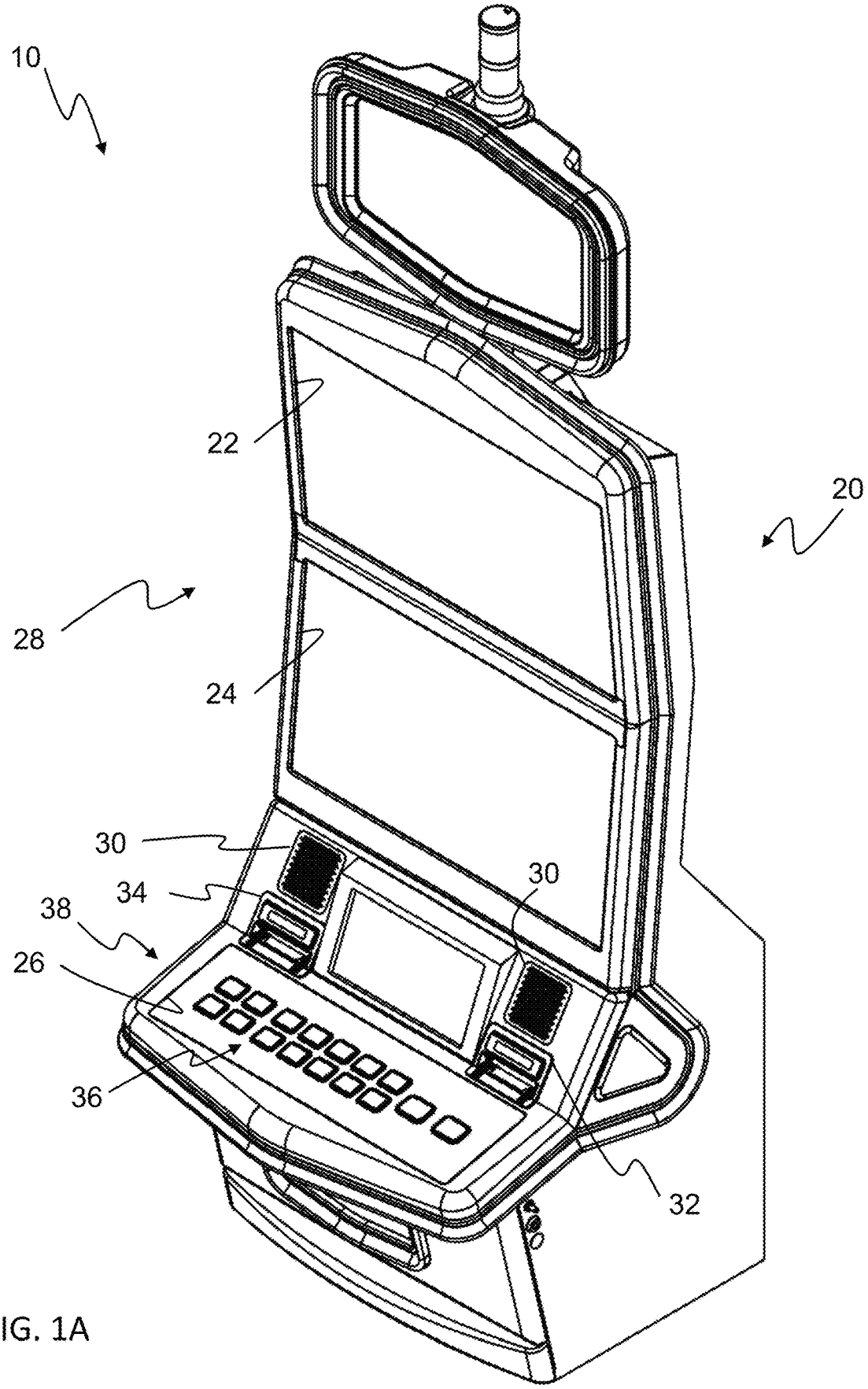
FIG. 1A is a perspective view of the gaming machine, according to the first embodiment.
Figure 1B:
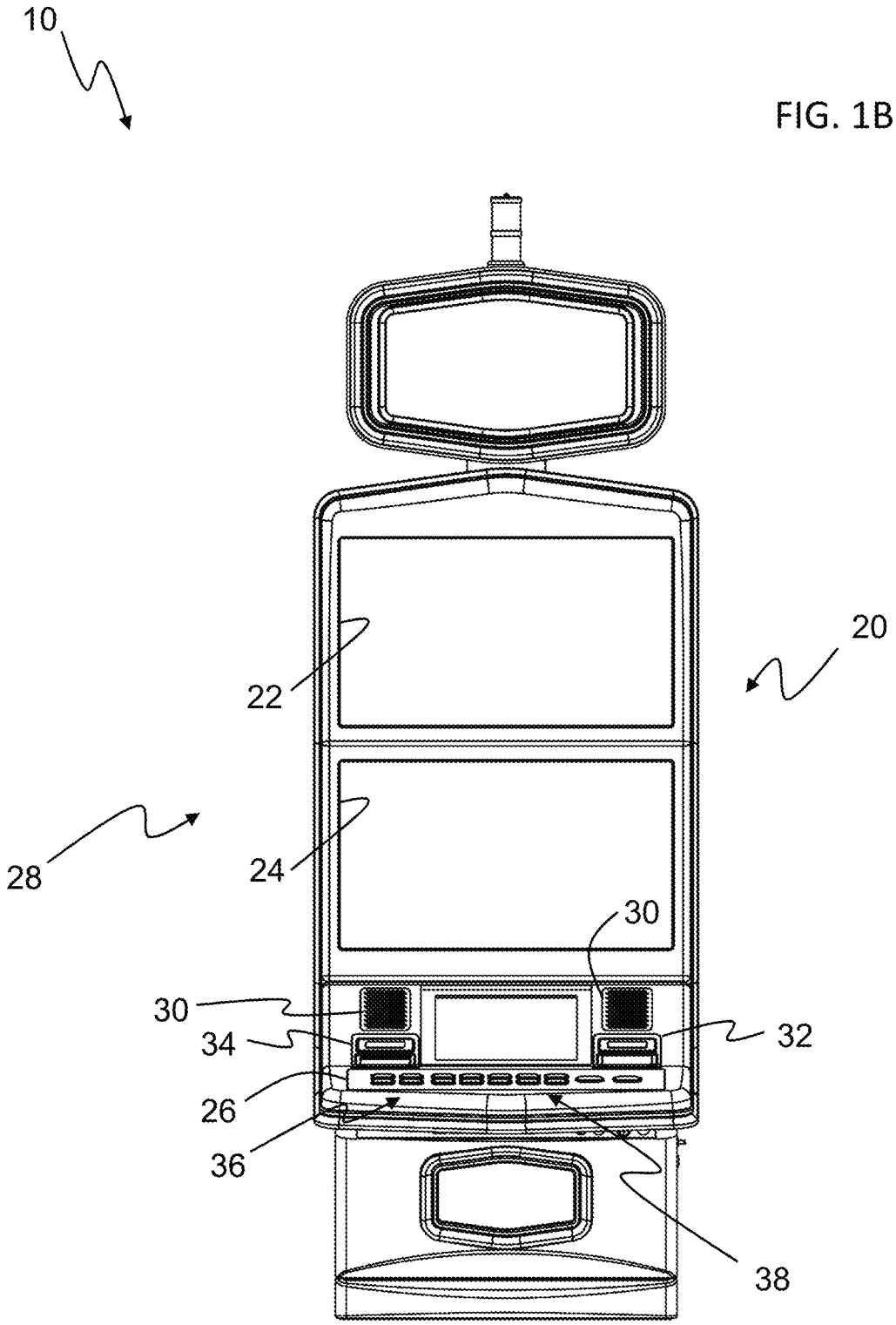
FIG. 1B is a front view of the gaming machine of FIG. 1A.

The gaming machine according to the present embodiment, receives a predetermined game value from the player, generates a game result, and provides a payout to the player according to the game result and one or more pay tables. FIG. 1A and FIG. 1B are a perspective view and a front view, respectively, of a gaming machine 10, according to the present embodiment. As shown in FIG. 1, this gaming machine 10 provides a cabinet 20 providing an upper display 22, a lower display 24, a control panel 26 and may also house a player tracking or ranking unit 57 (see FIG. 2). The cabinet 20 also houses a control unit 50 (see FIG. 2) that controls each part (see below). The control unit 50 also implements a random number generator (RNG) that is used during operation of the game. Each configuration is described below.

The upper display 22 and the lower display 24 may be flat panel display devices, such as both liquid crystal display devices and organic EL display devices and the like, and by controlling via each control unit 50, the display area mentioned below functions as a display unit 28 provided to the player.

Speakers 30 are provided on the left and right of the cabinet 20, and by controlling via the control unit 50, sound is provided to the player. On the control panel 26, a bill/ticket identification unit 32, the printer unit 34, and an operation unit 36 are provided.

The player tracking unit 57 may be housed on the center of the front surface of the cabinet 20 below the lower display 24. The player tracking unit 57 has a card reader that recognizes a player identification card, a display that presents data to the player, and a keypad that receives input by the player. This type of player tracking unit 57 reads information recorded on the player identification card inserted by the player into the card reader, and displays the information and/or information acquired by communicating with the external system on the display, by cooperatively operating with the control unit 50 mentioned below or an external system. Further, input from the player is received by the keypad, the display is changed according to the input, and communication with the external system is carried out as necessary.

The bill/ticket identification unit 32 is disposed on the control panel 26 in a state where the insertion opening that a bill/ticket is inserted into is exposed, an identification part that identifies a bill/ticket by various sensors on the inside of the insertion opening is provided, and a bill/ticket storage part is provided on the outgoing side of the identification part. The bill/ticket identification unit 32, receives and identifies bills/tickets (including vouchers and coupons) that are the game value as a game executing value, and notifies the control unit 50 mentioned below.

The printer unit 34 is disposed on the control panel 26 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer unit 34, under the control of the control unit 50 mentioned below, prints information on paper and outputs a ticket according to credit payout processing from the gaming machine 10. The output ticket can use the payout credit as game play by being inserted into the bill/ticket identification unit 32 of another gaming machine, or, can be exchanged for cash by a kiosk terminal inside of the casino or a casino cage.

The operation unit 36 receives the operation of the player. The operation unit 36 includes a group of buttons 38 that receives various instructions from the player on the gaming machine 10. The operation unit 36, for example, may include a spin button and a group of setting buttons. The spin button receives an instruction to start (start rotating the reel) the game listed below. The group of setting buttons 38 includes a group of bet buttons, a group of line-designation buttons, a max bet button, and a payout button and the like. The group of bet buttons receives an instruction operation regarding the bet amount of credits (bet number) from the player. The group of line-designation buttons receive an instruction operation that designate a pay line (referred to as an effective line below) subjected to a line judgment below from the player. The max bet button receives an instruction operation regarding the bet of the maximum amount of credits that can be bet at one time from the player. The payout button receives an instruction operation instructing a credit payout accumulated in the gaming machine 10.

Figure 2:
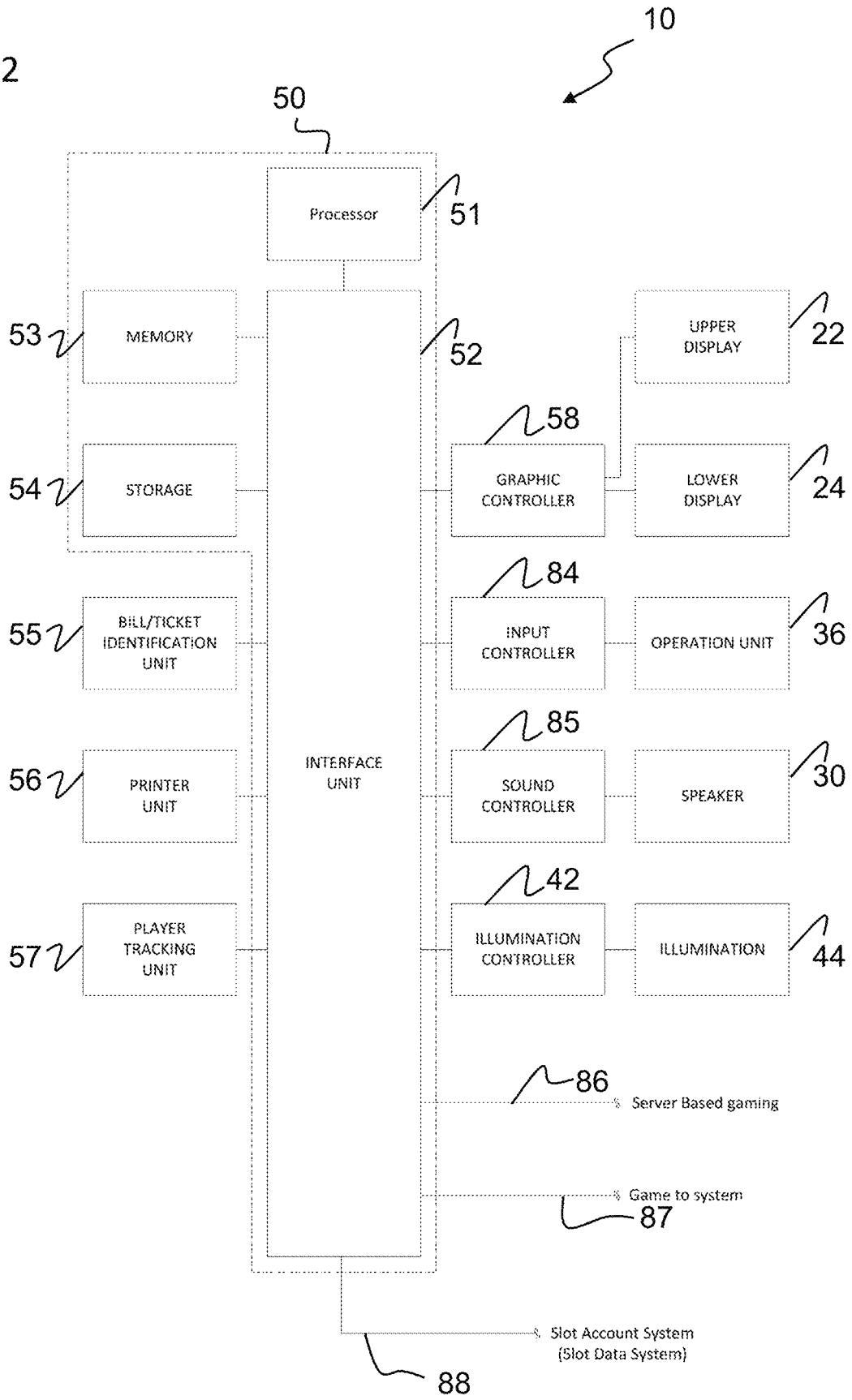
FIG. 2 is a functional block diagram of the gaming machine in FIG. 1.

With reference to FIG. 2, further on the inside of cabinet 20, a control board equipped with a central processing unit 51 (abbreviated as CPU below) that configures the control unit 50, an interface unit (or part) 52, a memory 53 and a storage 54 and the like are incorporated. The control board is configured so that communication is possible through the interface unit 52 and each of the components equipped on the cabinet 20, controls the operation of each part by executing the program recorded in the memory 53 or the storage 54 of the CPU 51, and provides a game to the player.

FIG. 2 shows a functional block diagram of the gaming machine 10, according to the present embodiment. The gaming machine 10 provides the control unit 50. The control unit 50 is configured as the interface unit 52 including a chip set providing communication functions of the CPU 51, a memory bus connected to a CPU 51, various expanding buses, serial interfaces, USB interfaces, Ethernet (registered trademark) interfaces and the like, and a computer unit where the CPU 51 provides the addressable memory 53 and the storage 54 through the interface unit 52. The memory 53 can be configured to include RAM that is a volatile storage medium, ROM that is a nonvolatile storage medium, and EEPROM that is a rewritable nonvolatile storage medium. The storage 54 provides the control unit 50 as an external storage device function, can use reading devices such as a memory card that is a removable storage medium, and a magneto optical disk and the like, and can use hard disks.

On the interface unit 52, in addition to the CPU 51, the memory 53, and the storage 54, a bill/ticket identification unit 55, a printer unit 56, the player tracking unit 57, a graphic controller 58, an input controller 84, and a sound controller 85 are connected. That is, the control unit 50 is connected to the operation unit 36 through the input controller 84, and connected to the upper display 22 and/or the lower display 24 through the graphic controller 58. Further, when illumination 44 that provides decorative lighting to the gaming machine 10 is provided, the illumination is controlled under the control of the control unit 50 on the interface unit 52, and an illumination controller 42 that provides a decorative lighting effect may be connected.

The control unit 50, which includes memory 53 and storage 54, controls each part by executing a program stored in the memory 53 and the storage 54, and provides a game to the player. Here, for example, the memory 53 and storage 54 may be configured to store a program and data of an operating system and subsystem that provide the basic functions of the control unit 50 to the EEPROM of the memory 53, and stores a program and data of an application that provides a game to the storage 54. According to such a configuration, it can be easy to change or update a game by replacing the storage 54. Further, the control unit 50 may be a multiprocessor configuration that has a plurality of CPUs.

Each block connected to the control unit 50 is described below. The bill/ticket identification unit 55 corresponds to the bill/ticket identification unit 32, receives bills/tickets in the insertion opening, and notifies the control unit 50 of identifying information corresponding to the assortment of bills or the payout processing of credits. The bill/ticket identification unit 55 notifies the information to the control unit 50, and the control unit 50 increases the usable credit amount inside of the game according to the notified content. The printer unit 56 corresponds to the printer unit 34, and under the control of the control unit 50 that receives an operation of the payout button of the group of setting buttons 38, information corresponding to the credit payout processing from the gaming machine 10 is printed and output on a printed ticket.

The player ranking (or tracking unit) unit 57 cooperatively operates with the control unit 50, and sends and receives information and the like of the player from the casino management system. The graphic controller 58 controls the upper display 22 and the lower display 24, under the control of the control unit 50, and displays a display image that includes various graphic data. The sound controller 85 drives the speakers 30 under the control of the control unit 50, and provides various sounds such as an announcement, sound effects, BGM and the like.

Further, the interface unit 52, has various communication interfaces for communicating with the exterior of the gaming machine 10, for example the interface unit 52 can communicate with an external network by Ethernet 86, 87, and a serial interface 88. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3:
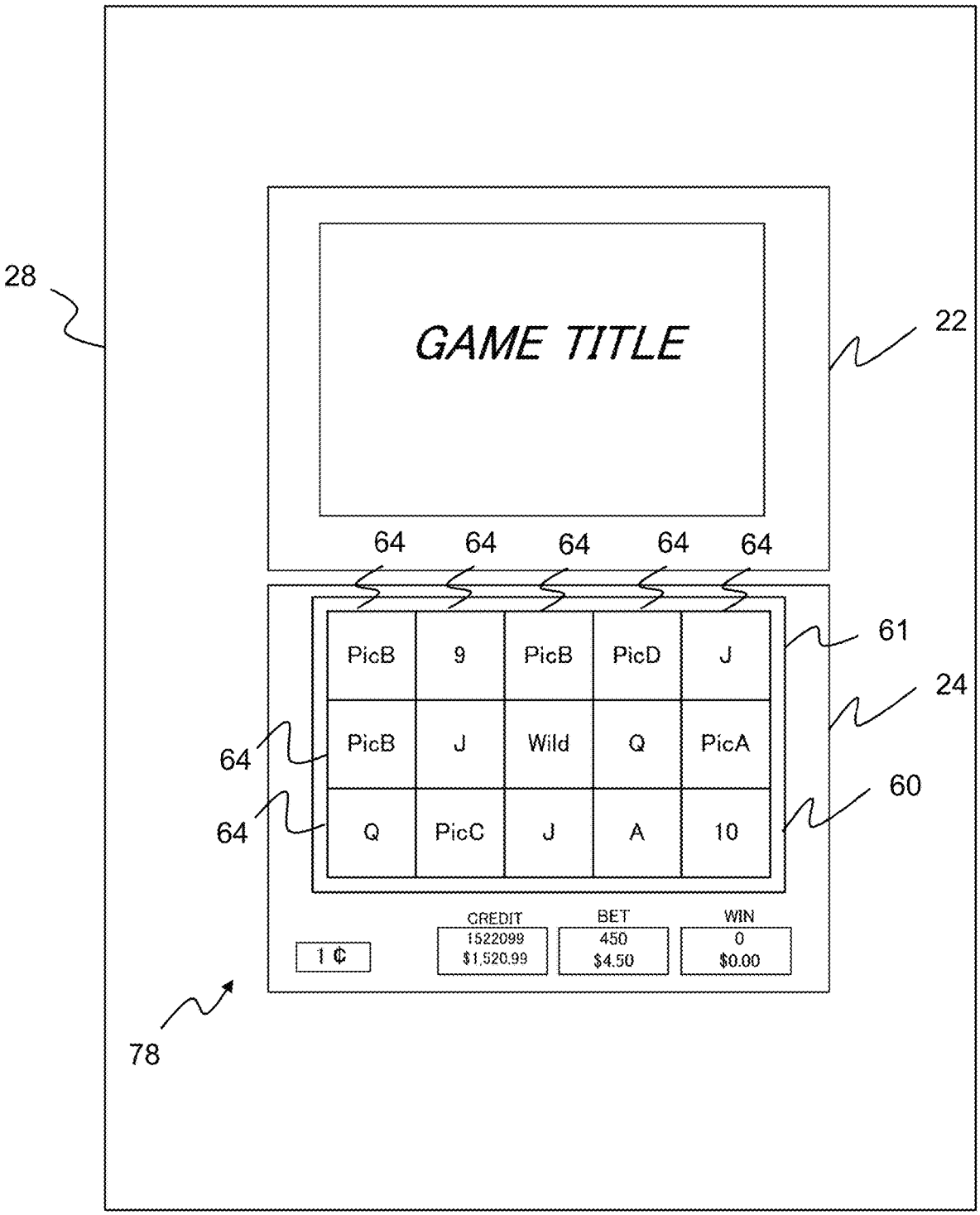
FIG. 3 is a first diagrammatic illustration of a display area of the gaming machine in FIG. 1, according to an embodiment of the present invention.

FIG. 3 schematically shows a display area 78 provided by the gaming machine 10. Such a display area 78 is displayed on the display unit 28 (the upper display 22 and/or the lower display 24) by the control unit 50 executing a predetermined program. In the illustrated embodiment, the display area 78 is displayed on the lower display 24. For instance, as shown, during the primary game and/or the bonus game, the upper display 22 may be utilized to display game related information, e.g., game title information and/or graphics.

In one aspect of the present invention, the gaming machine 10 provides a game to the player. The game may include a primary game and a game feature. The game feature may include one or more of (1) a multiplier applied to an award or payline, (2) a number of free games or spins, and/or (3) a bonus game. For instance, the primary game may be a video slot game, and the game feature may be the awarding of a number of free games or spins in response to the occurrence of a trigger condition, e.g., during the primary game. During the free spins, the game feature may also be provided.

Returning to FIG. 3, the game of the present invention utilizes a grid 60 in the display area 78 during the primary game and the free spins (if provided). The illustrated embodiment shows the state of displaying the display area 78 in the lower display 24. As shown in FIG. 3, the display area 78 includes the grid 60 for displaying symbols. By using such a display area, the gaming machine 10 of the present embodiment operates as a slot machine that pays a payout according to a winning combination of symbols displayed on the display area 78.

The display unit 28 displays a plurality of symbols in the grid 60. The grid 60 has a plurality of rows (r) and columns (c). The grid 60 is configured by a plurality of cells 64 that are the stop position of symbols.

With reference to FIG. 3, the grid 60 may be displayed on the lower display 24. The upper display 22 may be used to display animations and/or game identifying information during the primary game and/or during an attract mode. Further, the display unit 28 can display a decorative area, and an area that displays credit amount, bet number, and a credit amount obtained by winning (WIN number) and the like, outside of the grid 60. On each of the plurality of cells 64 of the display area 78, one symbol is stopped and displayed.

Figure 4:
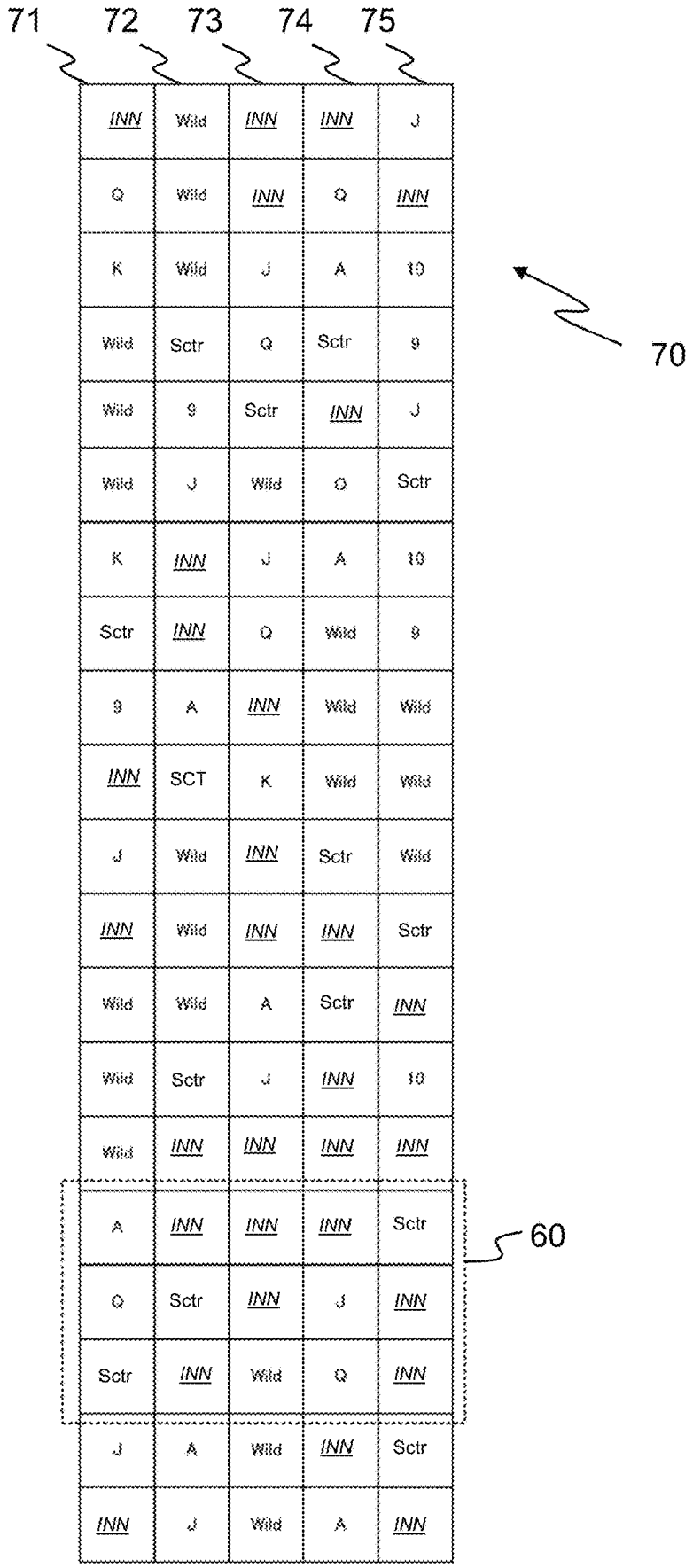
FIG. 4 is a figure showing an exemplary symbol arrangement showing the order of symbols displayed on the display area, according to an embodiment of the present invention.

On each cell 64 of the grid 60, as shown in FIGS. 3 and 4, a symbol is displayed based on the symbol arrangement of virtual reel strips 71 to 75 configured of a virtual reel set 70. That is, the cells 64 of the grid 60 correspond to the virtual reel strips 71 to 75 by column, and the symbols disposed on predetermined parts of each virtual reel strip 71 to 75 are displayed. Furthermore, by moving (scrolling or spinning) each symbol by column based on the symbol arrangement of the virtual reel strips 71 to 75, the symbols displayed in the cells 64 of the grid 60 change, and by stopping the movement (scrolling or spinning) by columns, the symbols are stopped. Here, the virtual reel strips 71 to 75 are data where the control unit 50 uses a program having the memory 53 or the storage 54, and data showing the symbol arrangement (i.e., the order of symbols on each reel) regulated by each cell column. Further, the virtual reel set 70 is a general term for such virtual reel strips 71 to 75.

Figure 5:
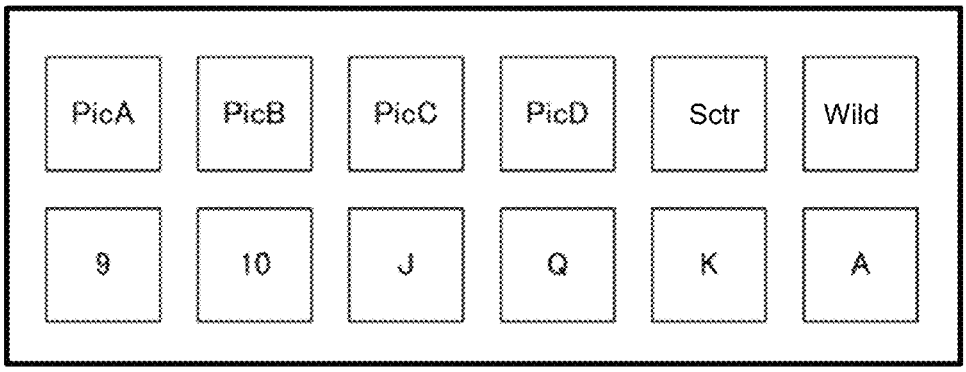
FIG. 5 is a figure showing the symbols displayed on the display area, according to an embodiment of the present invention.

Each virtual reel strip 71 to 75, in the examples of FIG. 4, may be configured by 20 symbols in respective symbol positions, and those symbols are aligned in an order defined by each reel. FIG. 5 is the details of symbols of the figure shown in FIG. 4. Each virtual reel strip 71 to 75 includes symbols selected from a symbol set of 13 varieties shown in FIG. 5. This symbol set includes card symbols ("9", "10", "J", "Q", "K", and "A") that imitate playing cards as regular symbols, and picture symbols ("PicA", "PicB", "PicC", and "PicD") that show a pattern. Further, this symbol set includes a wild symbol ("Wild") that is substituted as another symbol when a win combination is determined and a Scatter symbol ("Sctr") that is used to determine if a game feature is to be provided (see below). Each of these symbols have a different rank from each other regarding their value when winning, their rank gradually raises in this order: "9", "10", "J", "Q", "K", "A", "PicE", "PicD", "PicC", "PicB", "PicA". A combination of symbols that includes high-ranking symbols when winning, can obtain a larger winning payout compared to a combination of low-ranking symbols when winning.

As discussed above in one aspect of the present invention, the set of symbols may be divided into a first sub-group and a second sub-group. In the illustrated embodiment, the first sub-group includes the symbols "9", "10", "J", "Q", "K", and "A", and the second sub-group includes the symbols "PicE", "PicD", "PicC", "PicB", and "PicA". It should be noted that each symbol in the second sub-group have a higher ranking than all of the symbols in the first sub-group of symbols.

Returning to FIG. 4, in one embodiment, some of the symbol positions have a fixed symbol and others of the symbol positions have a varying symbol. In the illustrated embodiment, the fixed symbol positions have an associated symbol from the first symbol sub-group, a Wild symbol, or a Scatter (or Sctr) symbol. In one embodiment of the present invention, for each play of the primary game, one of the symbols from the second sub-group of symbols is randomly selected and associated/displayed in the varying symbol positions. In one embodiment, the same randomly selected symbol from the second sub-group of symbols is associated with or displayed in the varying symbol positions.

In another aspect of the present invention, all of the varying symbol positions or feature symbol positions (indicated as INN) are arranged in groups (or stacks) of adjacent symbol positions (within a reel strip).

It should be noted that in one aspect of the present invention, one or more dynamic virtual reel strips may be utilized. Using virtual reel strips, the symbols and/or symbol positions and/or virtual reel strips and/or length or size and/or any aspect of a virtual reel strip may change from change from one spin or play to the next. For example, a dynamic reel strip includes a plurality of symbol positions with symbols from the first symbol sub-group of symbols and a plurality of varying symbol positions (INN). The varying symbol positions may be in the form of one or more stacks, i.e., adjacent symbol positions. In one embodiment, the location and/or size of the stacks may change from one spin to the next, either randomly and/or in a predetermined pattern.

Alternatively, a virtual reel strip associated with a cell 64 (or column of cells 64) may be dynamically changed from one spin or play to another spin or play. This may occur randomly every spin or play and/or in a predetermined pattern.

It should be noted that in the illustrated embodiment, each column of the grid 60 has a corresponding reel strip. When the reel strip stops, a symbol from the respective reel strip appears in each one of the cells of the respective column of the grid 60. One or more of the reel strips 71 to 74 may be identical or all of the reel strips 71-75 may be different.

In an alternative embodiment, however, each cell 64 of the grid 60 has a respective independent reel that may spin independently of the other reels. Each cell 64 of the grid 60 may, thus, have an independent reel with a corresponding virtual reel strip 71 to 75. The virtual reel set 70 may include different number of virtual reel strips in such a case. For example, in an example in which a 3×5 grid is utilized, each cell 64 would have an associated virtual reel strip, so fifteen reel strips would be utilized. As above, one or more of the fifteen virtual reel strips may be identical or all reel strips may be different.

Once a symbol from the second sub-group of symbols has been selected and the varying symbol positions populated with the selected symbol, the reel strips 71, 72, 73, 74, 75 will only contain: symbols from the first sub-group of symbols, the selected symbol from the second sub-group of symbols, plus Wild and/or Scatter symbols (if used). Thus, as the reels spin, the player will see the lower ranking symbols and a large number of a single picture symbol. This will increase the player's anticipation of a large payout.

In the next several embodiments, the present invention will be described with respect to a 3×5 grid, however, it should be noted that the present invention is not limited to a grid with any specific size and/or shape. Furthermore, the below discussion describes a game having a primary game and a bonus game. The bonus game provides a plurality of free games and/or spins.

In general, the control unit 50 starts a game (either the primary game or a free spin in the bonus game), determines the stop position of each virtual reel strip 71 to 75 randomly, the virtual reel strips 71 to 75 move from a current position, and the operation to stop on a stop position uses the display unit 28 (for example, the lower display 24) and is expressed. Due to this, in the display or grid 60, the symbols included on the virtual reel strips 71 to 75 are continuously moved (scrolled or spun) in the vertical direction of the display area 78, and one symbol of one cell 64 aligned in an order of the symbol based on the symbol arrangement is stopped so that it is displayed.

The control unit 50 changes and stops the plurality of symbols displayed on the display unit 28 according to the operation of the player received by the operation unit 36, and a payout may be paid according to the stopped symbols inside the display area 78.

In the display area 78, a pay line is set that is used when winning is determined. The pay line is set to be extended over the column on the right end from the cells of the column of the left end, and is a line that combines the plurality of cells 64 determining a win. The number of effective lines within the set pay line is selected by the operation of a group of line designation buttons included in the group of setting buttons 38 of the operation unit 36 for the player. The control unit 50, in regards to the result of a game that is a combination of symbols, determines a win when a predetermined number of identical symbols is surpassed and aligned on a set pay line, and pays a payout to the player according to the type and number of symbols. On the gaming machine 10 of the present embodiment, a predetermined number of pay lines (LINE 1-40) of cells with three rows and five columns in the display area 78 is set (see FIG. 6). The system for determining a win may determine a win when a predetermined number of identical symbols from cells of the column on the left end are aligned on a set pay line, may determine a win when a predetermined number of identical symbols from cells of the column on the right end are aligned on a set pay line, and may determine a win when a predetermined number of identical symbols are aligned on a continuous column on a predetermined pay line. In addition, more than a predetermined number of the "Sctr" form a win combination or trigger condition regardless of the pay line.

Figure 6:
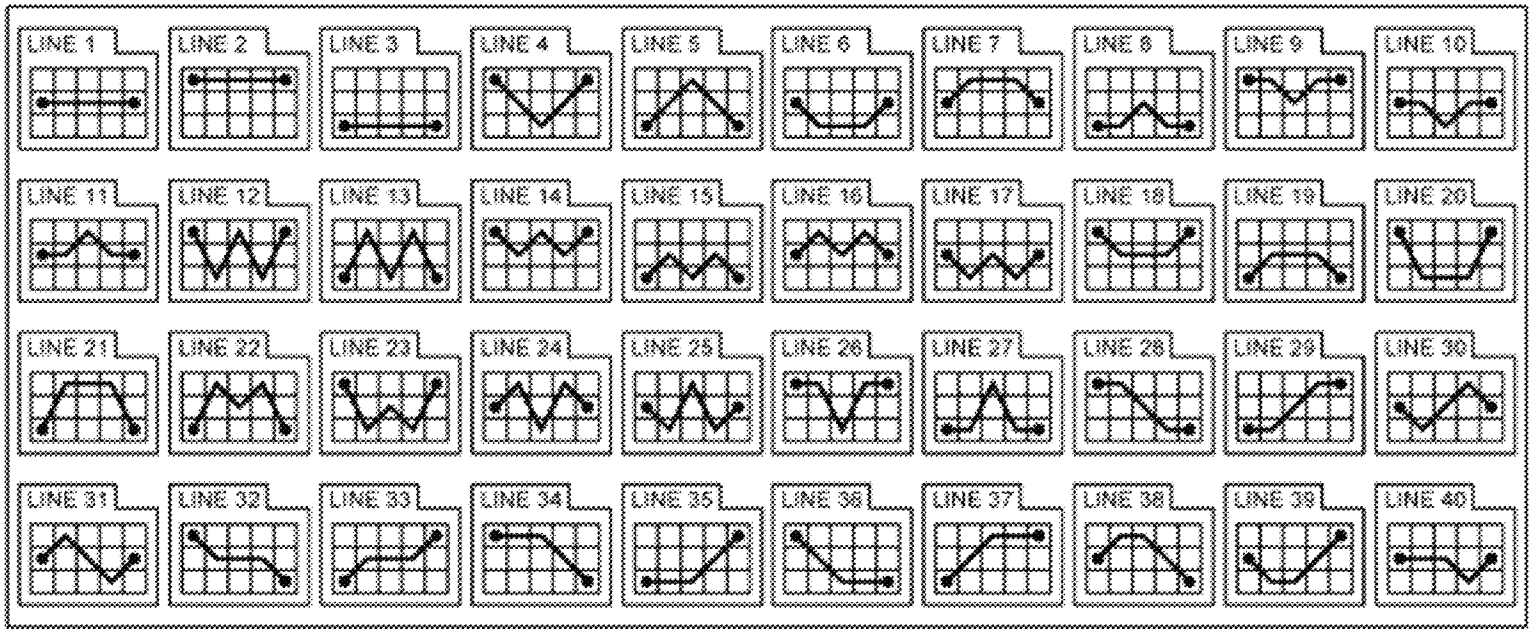
FIG. 6 is a figure showing one example of a pay line set on the determination area in FIG. 3.

It should be noted that pay lines shown other than (or in addition to) the pay lines shown in FIG. 6 may be used. In general, the pay lines shown in FIG. 6 start in the first column and end in the last column, and include one cell per column. However, one or more pay lines could include one or more cells in the same column and may include a vertical pay line.

Returning to FIGS. 1A-4, in one embodiment the gaming machine 10 includes an operation unit 36, a display unit 28 and a control unit 50. The operation unit 36 is configured to receive an operation of a player. The display unit 38 is configured to display a display area 78. The display area 78 includes a plurality of cells 64 arranged in a grid 60 and configured to display a respective symbol in each cell 64. The symbol displayed in each cell 64 is from a set of symbols. The symbols in the set of symbols have a ranking from lowest to highest. The set of symbols includes a first sub-group of symbols and a second sub-group of symbols. The symbols in the second sub-group of symbols have a higher ranking than all of the symbols in the first sub-group.

The control unit 50 is operably coupled to the operation unit 36 and the display unit 38 and is configured to allow a player to establish a wager and to provide a game in response to player operation. The control unit 50, in providing the game, randomly selects one of the symbols from the second sub-group of symbols. The selected symbol from the second sub-group of symbols and the first sub-group of symbols forming an instant sub-group of symbols. The instant sub-group of symbols may also include a Wild symbol and/or a Scatter (Sctr) symbol.

The control unit 50 randomly selects a plurality of symbols associated with the display area from the instant sub-group of symbols. Each selected symbol in the plurality of symbols is associated with one of the plurality of cells 64 in the grid 60 and form an outcome of the game. The control unit 50 may provide an award to the player as a function of the outcome of the game and a pay table.

In one embodiment, the game or primary game is a video slot game. The control unit 50 selects a plurality of symbols to display in the cells 64 of the grid 60 utilizing simulated reel strips 71-75 in a manner to simulate rotating reels. The plurality of symbols is displayed in the cells 64 of the grid 60 when the simulated rotating reels are stopped.

In one embodiment, the grid 60 may have a plurality of columns. Each column defines a reel of the video slot game and has an associated reel strip 71-75. In another embodiment of the present invention, each cell 64 of the grid 60 has an associated reel strip.

In one aspect of the present invention, at least one of the reel strips 71-75 includes at least one feature symbol position (marked as "INN" in FIG. 4). The control unit 50 is configured to associate the selected one of the symbols from the second sub-group of symbols with the at least one feature symbol position. In one embodiment, the at least one of the reel strips has a plurality of feature symbol positions. The feature symbol positions may be adjacent one another within the at least one of the reel strips forming one or a plurality of series of adjacent feature cells, i.e., stacks. Each of the reel strips 71-75, may include one or more stacks. In one embodiment, the selected one of the symbols from the second sub-group of symbols is associated with (all) the feature cells.

As discussed in more detail below, in a feature of the primary game (or a bonus game), the control unit 50 is configured to associate at least one of the feature cells with a multiplier and to apply the multiplier to the award of any outcome utilizing the associated feature cell.

In another embodiment of the present invention, the instant sub-group of symbols further includes a Wild symbol.

The instant sub-group of symbols may further include a Scatter symbol. In one embodiment, the appearance of a predetermined number of Scatter symbols in the outcome triggers a feature (see below). For example, the appearance of a predetermined number of Scatter symbols in the outcome of a game (primary or bonus) may include an award of a number of free spins.

In one aspect of the present invention, the first sub-group of symbols includes character symbols. In one embodiment, the character symbols may include the following symbols: 9, 10, J, Q, K, and A. In another aspect of the present invention, the second sub-group of symbols include picture symbols, e.g., PIC-A, PIC-B, PIC-C and PIC D. Since the instant sub-group of symbols includes the symbols in the first sub-group of symbols and one of the symbols from the second sub-group of symbols, the instant sub-group of symbols will only include one picture symbol. And since the award associated with a winning outcome based on a picture symbol will be greater than the award associated with a winning outcome based on a character symbol (since it has a higher ranking), the player will have increased anticipation of a (higher) win.

Figure 7:
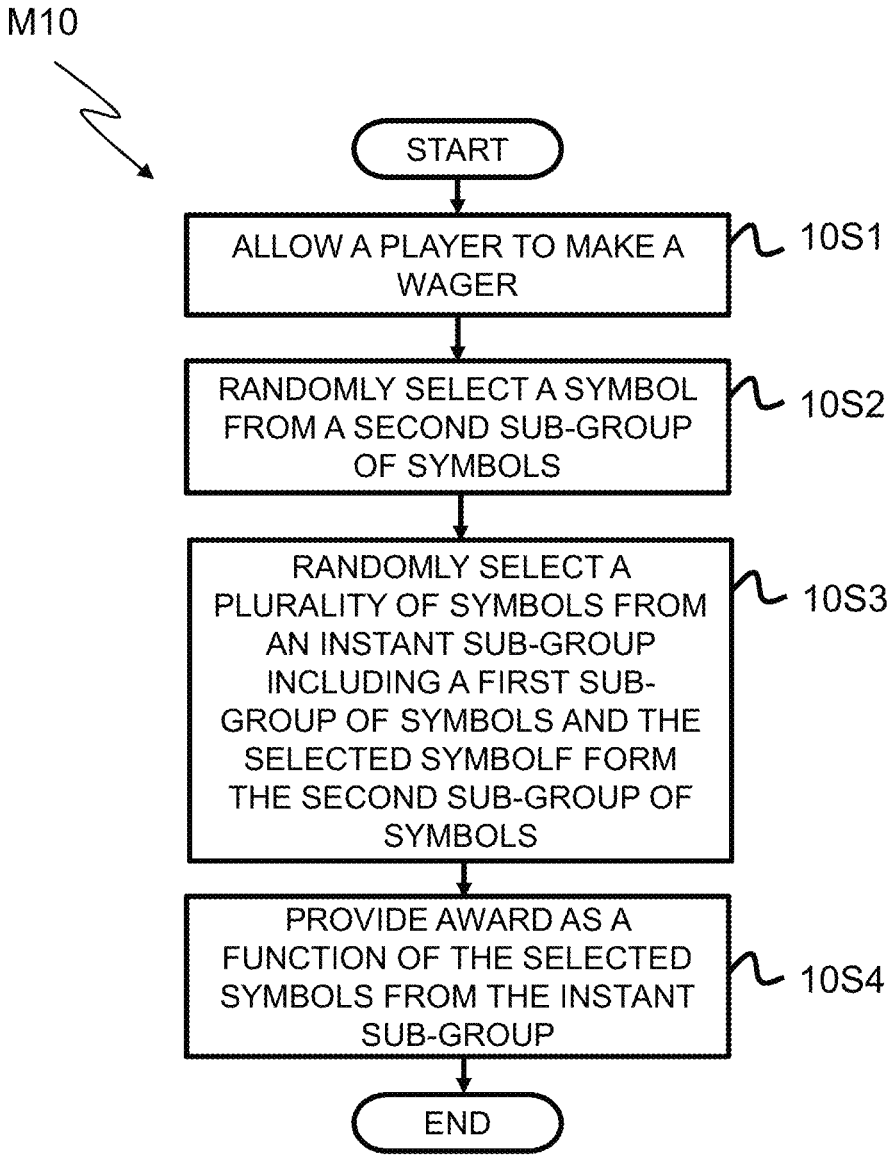
FIG. 7 is a flow chart describing the operation of the gaming machine during a game, according to one embodiment of the present invention.

With reference to FIG. 7, a method M10 provides a game to a player using a gaming machine 10. The gaming machine 10 including an operation unit 36, a display unit 28, and a control unit 50. The operation unit 36 is configured to receive an operation of a player. The display unit 38 is configured to display a display area 78. The display area 78 includes a plurality of cells 64 arranged in a grid 60 and configured to display a respective symbol in each cell 64. The symbol displayed in each cell 64 is from a set of symbols. The symbols in the set of symbols have a ranking from lowest to highest. The set of symbols includes a first sub-group of symbols and a second sub-group of symbols. The symbols in the second sub-group of symbols have a higher ranking than all of the symbols in the first sub-group. The control unit 50 is operably coupled to the operation unit 36 and the display unit 38 and is configured to allow a player to establish a wager and to provide a game in response to player operation. In A first step 10S1, a player is allowed to make a wager. In a second step 10S1, a symbol is randomly selected from the second sub-group of symbols. The selected symbol from the second sub-group of symbols and the first sub-group of symbols form an instant sub-group of symbols. The instant sub-group of symbols may also include a Wild symbol and/or a Scatter (Sctr) symbol.

In a third step 10S3, a plurality of symbols are selected from the instant sub-group of symbols and associated with the display area. Each symbol in the plurality of symbols is associated with one of the plurality of cells 64 in the grid 60. The plurality of symbols forming an outcome of the game.

In a fourth step 10S4, an award may be provided to the player as a function of the outcome of the game and a pay table.

The gaming machine 10 of the present embodiment provides a primary game (also referred to as a main game) and a multiplier game feature. The multiplier game feature may include one or more of multipliers applied to an award or payline. Generally, the game feature is provided when predetermined conditions, i.e., a triggering condition, are satisfied. Concerning a primary game (and any frees spins), the symbols displayed in the display area 78 configure a combination of symbols that are the result of a game, and determine a win.

It should be noted that the multiplier feature game may also be provided during any bonus game or free spin (see below). In one embodiment, the multiplier game feature is randomly provided during the primary game. The multiplier game feature may be provided in every free or bonus game or may be randomly provided.

In one embodiment of the present invention, the gaming machine 10 includes the operation unit 36, a display unit 22, 24 and a control unit 50. The operation unit 36 is configured to receive an operation of a player (see above). The display unit 22, 24 is operably coupled to the operation unit 36 and is configured to display a symbol display area 78. The symbol display area 78 includes a plurality of cells 64 arranged in a grid 60. As discussed above, the grid 60 has a plurality of rows and a plurality of columns.

The control unit 50 is operably coupled to the operation unit 36 and the display unit 22, 24 and is configured to initiate a game in response to player operation and to establish an outcome of the game. The control unit 50, in response to initiation of the game, being randomly selects a plurality of symbols associated with the symbol display area 78 of grid 60. Each symbol in the plurality of symbols is associated with one of the plurality of cells 64 in the grid 60. The plurality of symbols forms the outcome of the primary game.

In some embodiments, each symbol in the outcome of the primary game may be randomly selected. In the illustrated embodiment, the game is a video slot game. As discussed above, each column has an associated reel strip. In randomly selecting the symbols, the control unit 50 randomly determines a stop position (using a random number generator or RNG) for each reel strip and displays the outcome in a manner to simulate rotating reels. The symbol in each column in the outcome is a function of the associated reel strip and the randomly determined stop position.

In one embodiment, the multiplier game feature includes the following steps (performed, at least in part, by the control unit 50):

Randomly select a set of multipliers from a plurality of sets of multipliers;

Randomly associate each multiplier in the selected set of multipliers to one of the cells 64 in the grid;

Establish outcome of the game; and,

Apply multipliers to any award if certain conditions are met.

An exemplary plurality of sets of multipliers is listed below:

Set #1: 3, 3, 2, 2, 2, 2
Set #2: 3, 3, 2, 2, 2
Set #3: 5, 3, 2, 2
Set #4: 5, 2, 2, 2
Set #5: 3, 3, 2, 2
Set #6: 5, 2, 2
Set #7: 5, 3
Set #8: 3, 2, 2
Set #9: 3, 2
Set #10: 5; and
Set #11: 2, 2.

As shown, each set of multipliers, may include a single multiplier or multiple multiplier. Each set does not need to include the same number of multipliers as the other sets. Once one of the sets of multipliers is selected, one of the cells 64 of the grid 60 is randomly selected for each multiplier in the set of multipliers.

Figure 8:
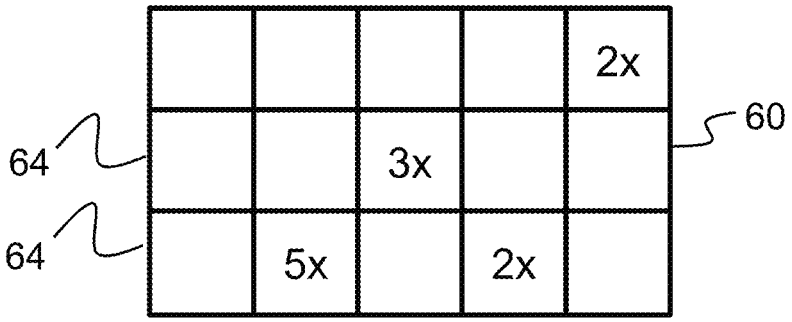
FIGS. 8-12 are diagrammatic illustrations of the display area of the gaming machine in FIG. 1, according to an embodiment of the present invention.

For instance, if the third set of multipliers, consisting of 5×, 3×, 2×, and 2× is randomly selected, then four of the cells 64 in the grid 60 are randomly selected and associated with one of the multipliers. This is illustrated in FIG. 8, in which each multiplier in the selected set of multipliers is randomly associated with one of the cells 64 in the grid 60. It should be noted that in the illustrated embodiment, the multipliers in the selected set are not displayed on the grid 60 when associated with the respective cell, i.e., FIG. 8 is for explanation only.

After the multipliers from the selected set of multipliers have been associated with a respective cell 64, the game is played and an outcome of the game is established. The outcome of the game includes a symbol from the set of symbols being associated with each one of the cells 64 in the grid 60.

The multipliers are applied to any award (based on the outcome of the game) if certain conditions are met.

Each multiplier may be applied (or not applied) independently. For example, in one embodiment, a multiplier is applied if the symbol position (from the respective reel strip) that corresponds to the cell 64 associated with the multiplier is a feature symbol position. As discussed above, in certain embodiments, the feature symbol positions contain a symbol randomly selected from the second sub-group of symbols. In other embodiments, the reels may contain multiple symbol positions which are adjacent, forming one or more stacks.

With reference to FIGS. 9-12, in one embodiment, each cell 64 has a respective reel strip which define an independent reel. Thus, fifteen reel strips are used. Each reel strip may have one or more stacks of adjacent symbol positions. The symbol positions in each stack contain an identical symbol. In the illustrated embodiment, the adjacent symbol positions in the stacks are feature symbol positions as discussed above.

Figure 9:
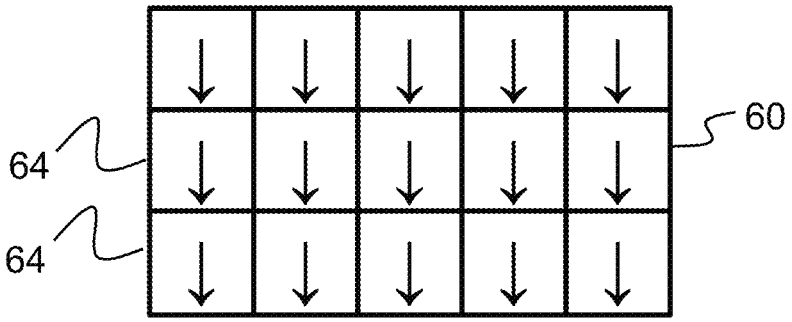
Figure 10:
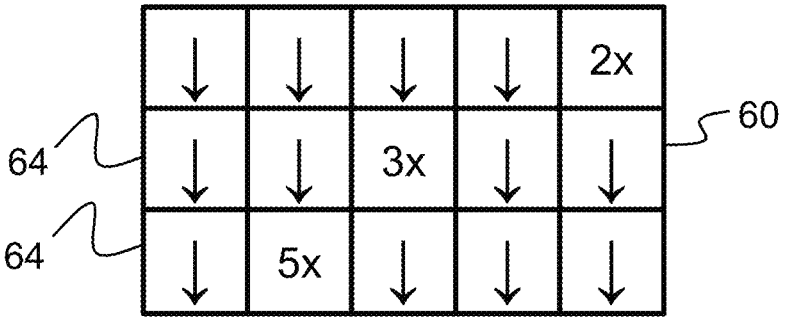
Figure 11:
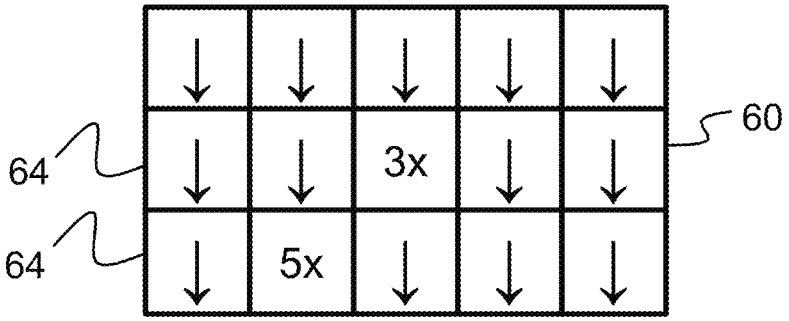

At the start of each game or spin, all of the individual reels are spun (see FIG. 9). As shown in FIGS. 10-11, when a symbol position in the stack of adjacent symbol positions is within the respective cell 64, a graphic or image indicative of the multiplier that has been assigned to the cell 64 in the grid 60 is displayed. This graphic disappears once the stack of adjacent symbol position is no longer within the respective cell 64. For example, as shown in FIG. 10, graphics representative or indicative of the 5×, 3×, and 2× multipliers are displayed on the grid as a stack passes through the respective cell. In FIG. 11, the stack in the cell 64 associated with the 2× multiplier is no longer within the cell 64, so the graphic disappears.

Figure 12:
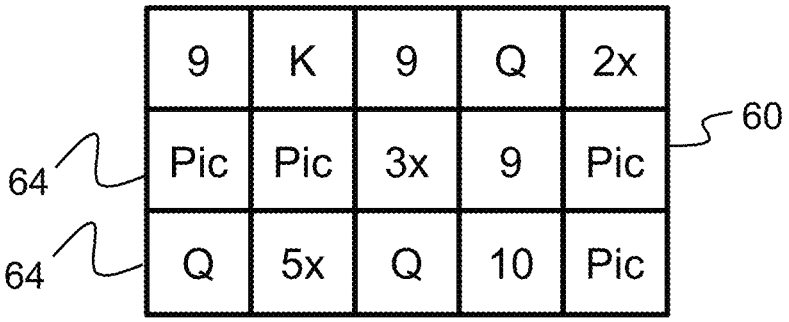

With reference to FIG. 12, once the individual reels have stopped, one of the symbols of each reel strip is associated with the respective cell 64 of the grid 60. If the symbol position of the associated symbol is not a feature symbol position or the corresponding cell does not have a multiplier associated therewith, then the symbol is displayed. For example, in the first column of the grid 60 shown in FIG. 12, the following symbols are displayed (top to bottom): 9, Pic, Q. It should be noted the symbol "Pic" is replaced with the symbol randomly selected from the second sub-group of symbols (see above). However, if the symbol associated with a cell 64 is one of the symbols in a stack of adjacent symbol positions and the cell 64 of the grid 60 has an associated multiplier, then the graphic representing the multiplier is displayed. As shown in FIG. 12, the cells 64 of the grid which have associated multipliers of 5×, 3×, 2× contain one of the symbols in a stack of adjacent symbol positions, and thus, respective graphics are displayed over the underlying symbol (forming a new or modified symbol).

The displayed multipliers are applied to one or more awards based on the outcome of the game. In the one embodiment, the multipliers are first multiplied together and then applied to the award. In the illustrated example, the multipliers are multiplied together (5×3×2=30). The resultant multiplier (30×) is then applied to the award.

In another aspect of the present invention, a free game or bonus game feature may be provided. In one embodiment, the free game or bonus game feature is triggered during the main game. The control unit 50 determines if a trigger condition has occurred during the primary game. If the trigger condition has occurred, then the bonus game feature is provided. In one embodiment, the trigger condition is defined as the appearance on a predetermined number of one of a predetermined one of the symbols in a feature area 61 of the grid. The feature area 61 is defined a predefined subset of the cells 64 of the grid 60. The subset may include less than or all of the cells 64 of the grid 60.

The control unit 50 establishes one of a plurality of predefined subsets of the cells 64 as the feature area 61. In one embodiment, the feature area 61 is established as a function of the wager made by the player. The control unit 50 provides a game in response to player operation. The control unit 50, in providing the game, randomly selects a plurality of symbols associated with the display area 78. Each symbol in the plurality of symbols being associated with one of the plurality of cells 64 in the grid 60. The plurality of symbols form an outcome of the game. An award may be awarded to the player as a function of the outcome of the game and a pay table.

In one embodiment, the control unit 50 is configured to detect an occurrence of a predetermined symbol in the outcome of the primary game and to responsively provide a game feature as a function of the occurrence of the predetermined symbol in the outcome of the main game. The bonus game feature may include a number of free games (or spins). The predetermined symbol may be the scatter symbol. The number of free games may be predetermined, randomly determined and/or determined as a function of the number of occurrences of the scatter symbol in the feature area. For example, in one embodiment five, eight, twelve or twenty free spins are provided upon the occurrence of three, four, five and six scatter symbols, respectively.

In one aspect of the present invention, the reel strips used in the free game feature are different than the reel strips 71-75 used in the main game.

In another aspect of the invention, the multiplier game feature may be provided during the main game and/or in the free game feature. In one embodiment, the multiplier game feature is randomly provided in the main game and randomly provided in the free game feature. In an alternate embodiment, the multiplier game feature is provided on every free game in the free game features.

With reference to FIGS. 13A-13D, a method M20 provides a game including a primary game, a multiplier feature, and a free game feature according to an embodiment of the present invention.

Figure 13A:
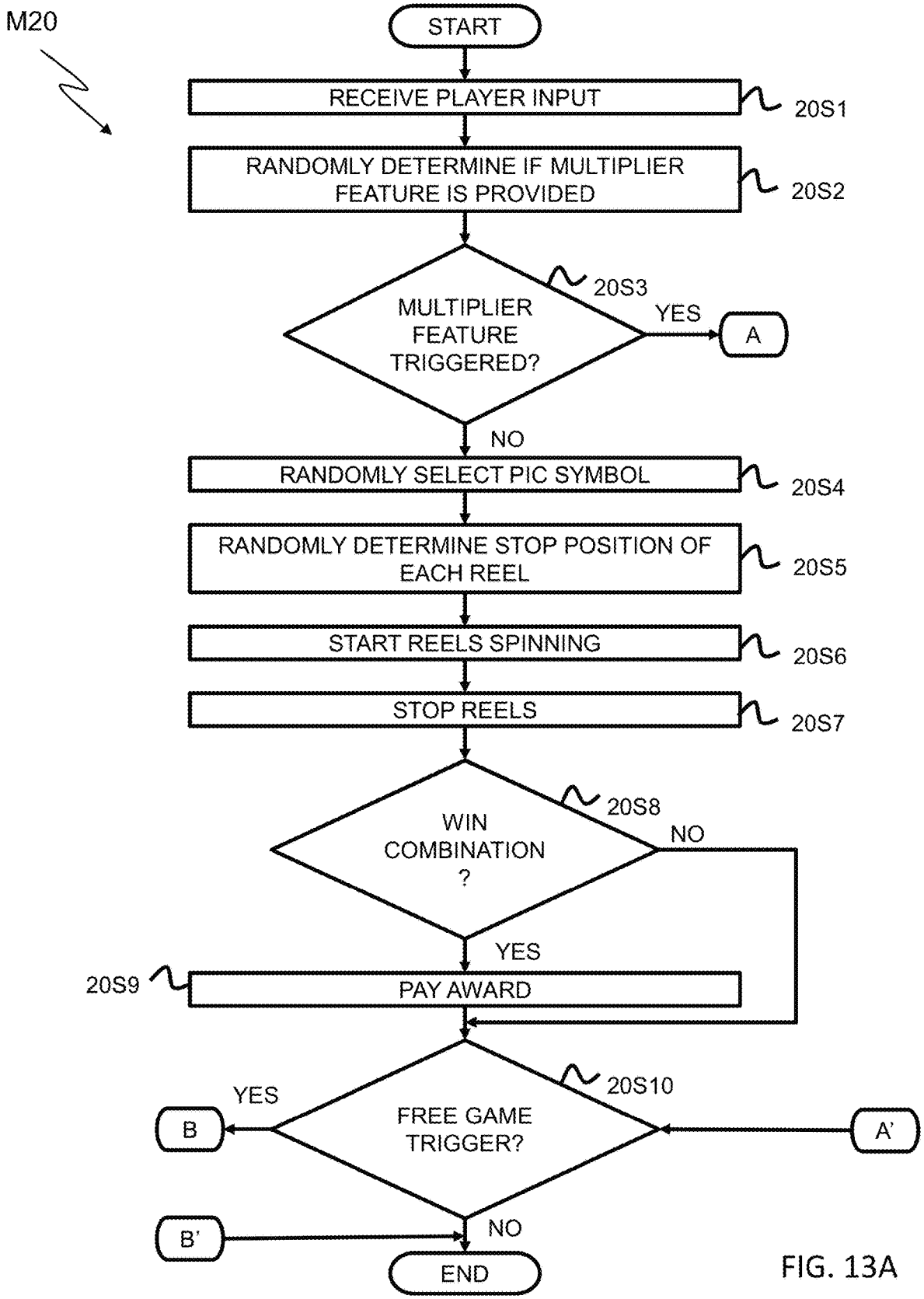
FIGS. 13A, 13B, 13C and 13D illustrate a flow chart describing the operation of the gaming machine during a game, according to one embodiment of the present invention.

With particular reference to FIG. 13A, in the illustrated embodiment the multiplier feature is randomly provided in the primary game. In a first step 20S1, player input, e.g., actuation of a SPIN button, is received and a primary game is initialized. In a second step 20S2, the method M20 randomly determines whether the multiplier feature will be provided. In a third step 20S3, if the multiplier feature is to be provided, then the method M20 proceeds to an eleventh step 20S11. Starting in the eleventh step 20S11, the primary game with the multiplier feature is provided (see below).

Otherwise, the method M20 proceeds to a fourth step 20S4 and the primary game is provided without the multiplier feature.

In one embodiment, the outcome of the primary game includes a game symbol in each cell 64 of the grid 60. As discussed above, each cell 64 may have a separate individual reel. Thus, in the illustrated embodiment, a 3×5 grid is used. Since each cell 64 has an individual reel, 15 reels are used. Each reel has an associated reel strip. The reel strip associated with a particular reel/cell may be the same or different as the reel strip associated with a different particular reel/cell.

Figure 14:
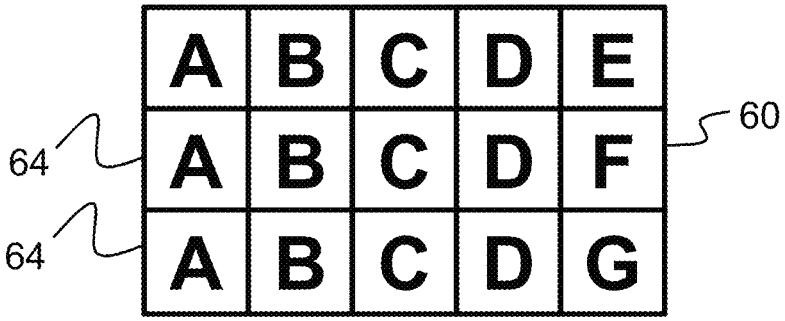
FIG. 14 is a graphic illustrating a sample grid with associated reel strips.

In one embodiment there may be seven available reel strips: A, B, C, D, E, F, and G. Each reel strip may be assigned to one or more of the reels/cells. For example, as shown in FIG. 14, reel strip A is assigned to each cell 64 in the first column of the grid 60; reel strip B is assigned to each cell 64 in the second column of the grid 60; reel strip C is assigned to each cell 64 in the third column of the grid 60; and reel strip D is assigned to each cell 64 in the fourth column of the grid 60. Further as shown, reel strips E, F and G are assigned to a respective one of the cells in the fifth column. It should be noted, however, that a different number of available reel strips and/or a different arrangement of reel strips to reels/cells may be used.

As discussed above, the set of symbols or game symbols includes a first sub-group of symbols and a second sub-group of symbols. Returning to FIG. 13A, as discussed above, each reel strip has a plurality of symbol positions, e.g., ten, twenty-one, or one hundred. In the illustrated embodiment, each symbol position of each reel strip may be either (1) populated with one of the symbols from the first sub-group or (2) be designated as a varying symbol positions or feature symbol position (INN).

Returning to FIG. 13A, in the fourth step 20S4, the method M20 randomly selects a PIC symbol from the second sub-group of symbols. In one embodiment as discussed above, the symbols in the set of symbols have a ranking from lowest to highest. The symbols in the second sub-group of symbols have a higher ranking than all the symbols in the first sub-group. In the illustrated embodiment, the first sub-group of symbols comprise character symbols and the second sub-group of symbols comprise PIC symbols.

In a fifth step 20S5, a stop position of each of reels is randomly determined. In a sixth step 20S6, spinning of the reels is initiated. In a seventh step 20S7, the reels are stopped. Initiation of the reels may begin simultaneously or in a predetermined pattern, e.g., from left to right. Likewise, stopping of the reels may occur simultaneously or in a predetermined pattern, e.g., from left to right.

In an eighth step 20S8, the outcome of the primary game is evaluated and if a win combination exists, then the method M20 proceeds to a ninth step 20S9. Otherwise, the method M20 proceeds to a tenth step 20S10.

In the ninth step 20S9, an award is paid to the player based on the outcome of the primary game, any winning combination and a pay table.

In the tenth step 20S10, if the free game trigger has occurred (see above), then the method M20 proceeds to a twenty-first step 20S21 and the free game feature is provided (see below). Otherwise, the method M20 ends.

Figure 13B:
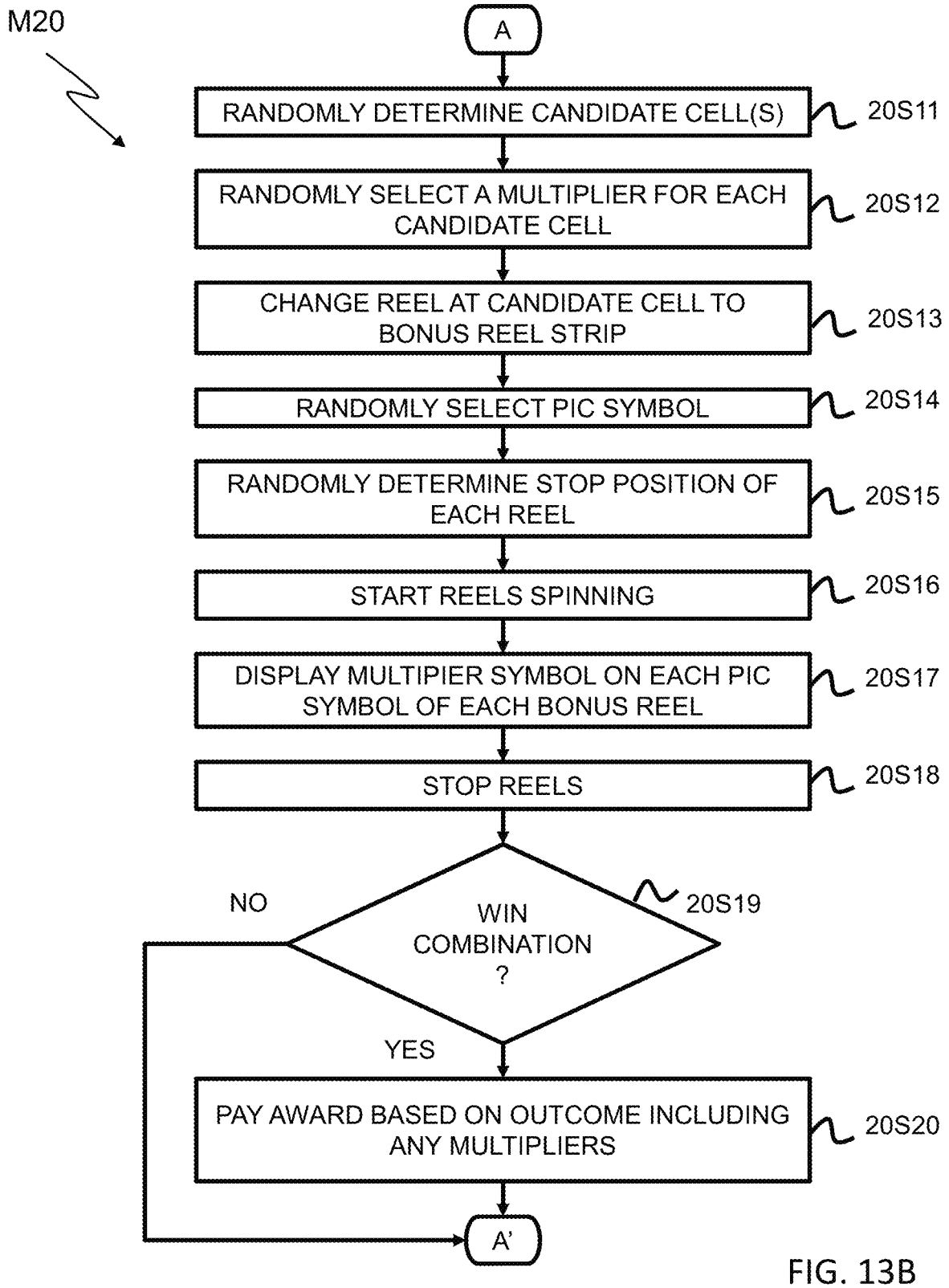

With particular reference to FIG. 13B, starting with the eleventh step 20S11, the primary game is provided with the multiplier feature. In the eleventh step 20S11, one or more of the cells 64 of the grid 60 are randomly determined as candidate cells. In a twelfth step 20S12, a multiplier is randomly selected for each candidate cell. In one embodiment, the multiplier(s) are randomly selected from a set of predetermined multipliers, e.g., 2×, 3, and 5×.

In one embodiment of the present invention, a different reel strip is used for each candidate cell. For example, in the above embodiment, each cell 64 has an associated reel strip from the set of reel strips including reel strips A, B, C, D, E, F and G. Each reel strip has an associated bonus or multiplier reel strip: A', B', C', D', E', F' and G'. The reel strip associated with each cell 64 that has been selected as a candidate cell is changed to the respective multiplier reel strip. It should be noted that the length of, i.e., the number of symbol positions in, the multiplier reel strips may be different than the length, i.e., the number of symbol positions in, the reel strips.

In the thirteenth step 20S13, the reel strip associated with each candidate cell is changed to a respective bonus or multiplier feature reel strip. In the fourteenth step 20S14, the method M20 randomly selects a PIC symbol from the second sub-group of symbols. The selected PIC symbol is used in each of the variable symbol position(s) of each of the reel strips and/or multiplier feature reel strips.

In a fifteenth step 20S15, a stop position of each of reels is randomly determined. In a sixteenth step 20S16, spinning of the reels is initiated.

In one embodiment, the selected multiplier for a candidate cell is applied only if the selected PIC symbol is to be displayed in the outcome of the primary game. Thus, the variable symbol position on each reel strip associated with a reel associated with a candidate cell, a multiplier graphic is added to the variable symbol position(s) (INN). The multiplier graphic(s) are displayed over or on top of the underlying symbol (forming a new symbol, i.e., a multiplier symbol). For instance, if the randomly selected symbol (in the fourteenth step 20S14) is the PIC-D symbol and the selected multiplier for a candidate cell is 2×, then a symbol that includes the PIC-D symbol and the multiplier is placed within each variable symbol position for the respective multiplier feature reel strip in the seventeenth step 20S17. As the reel/reel strip rotates through the candidate cell, the modified symbol is displayed.

In an eighteenth step 20S18, the reels are stopped.

In a nineteenth step 20S19, the outcome of the primary game is evaluated and if a win combination exists, then the method M20 proceeds to a twentieth step 20S20. Otherwise, the method M20 ends.

In the twentieth step 20S20, an award is paid to the player based on the outcome of the primary game, any winning combination and a pay table. If the winning combination includes a PIC symbol accompanied by a multiplier, the multiplier is applied. In one embodiment, each multiplier appearing to the outcome is applied only to awards resulting from a winning combination that includes the multiplier. In another embodiment, the multipliers appearing in the outcome are multiplied together and the product is applied to the sum of the award(s) from all winning outcomes. After the twentieth step 20S20, the method M20 ends.

Figure 13C:
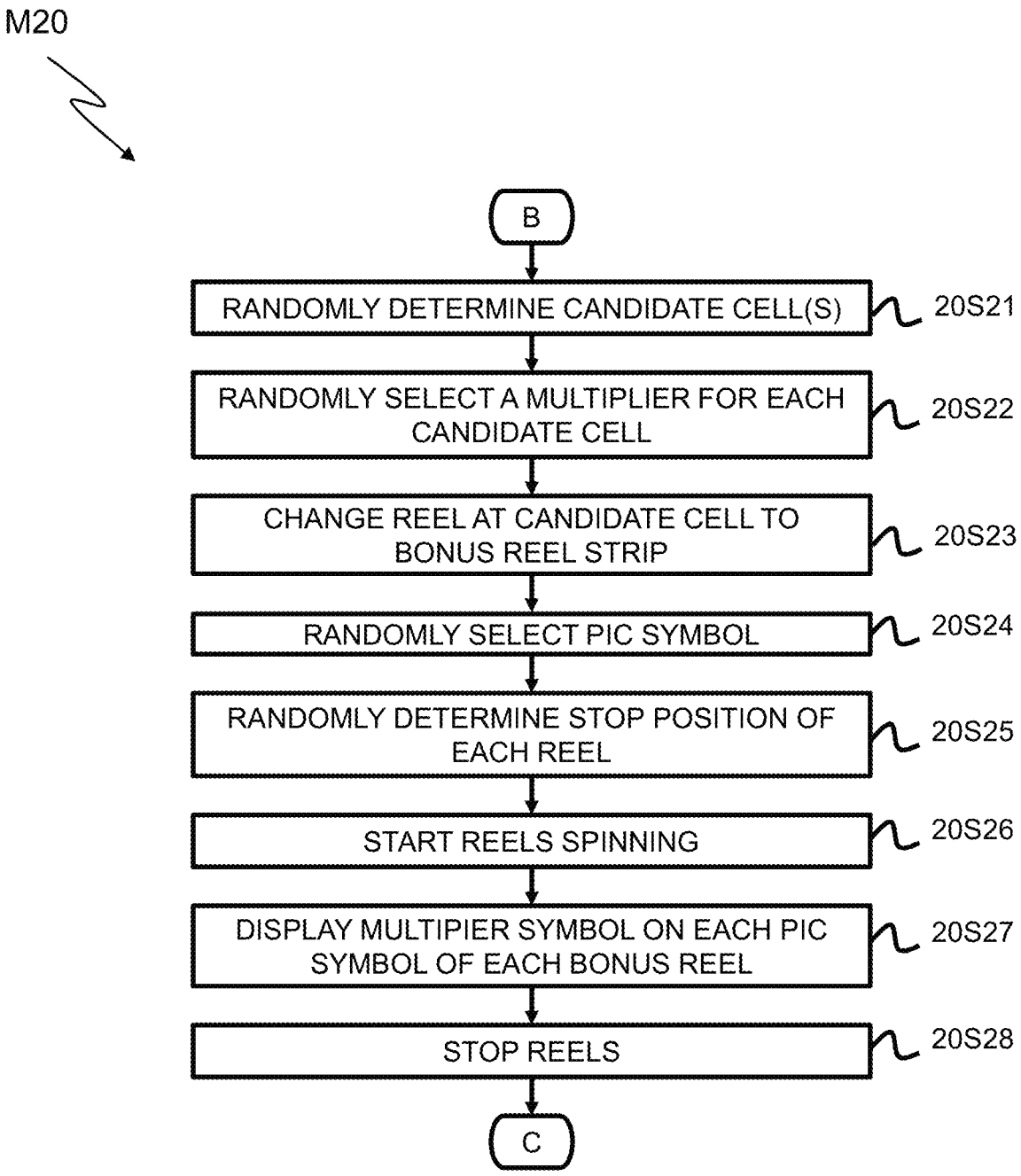
Figure 13D:
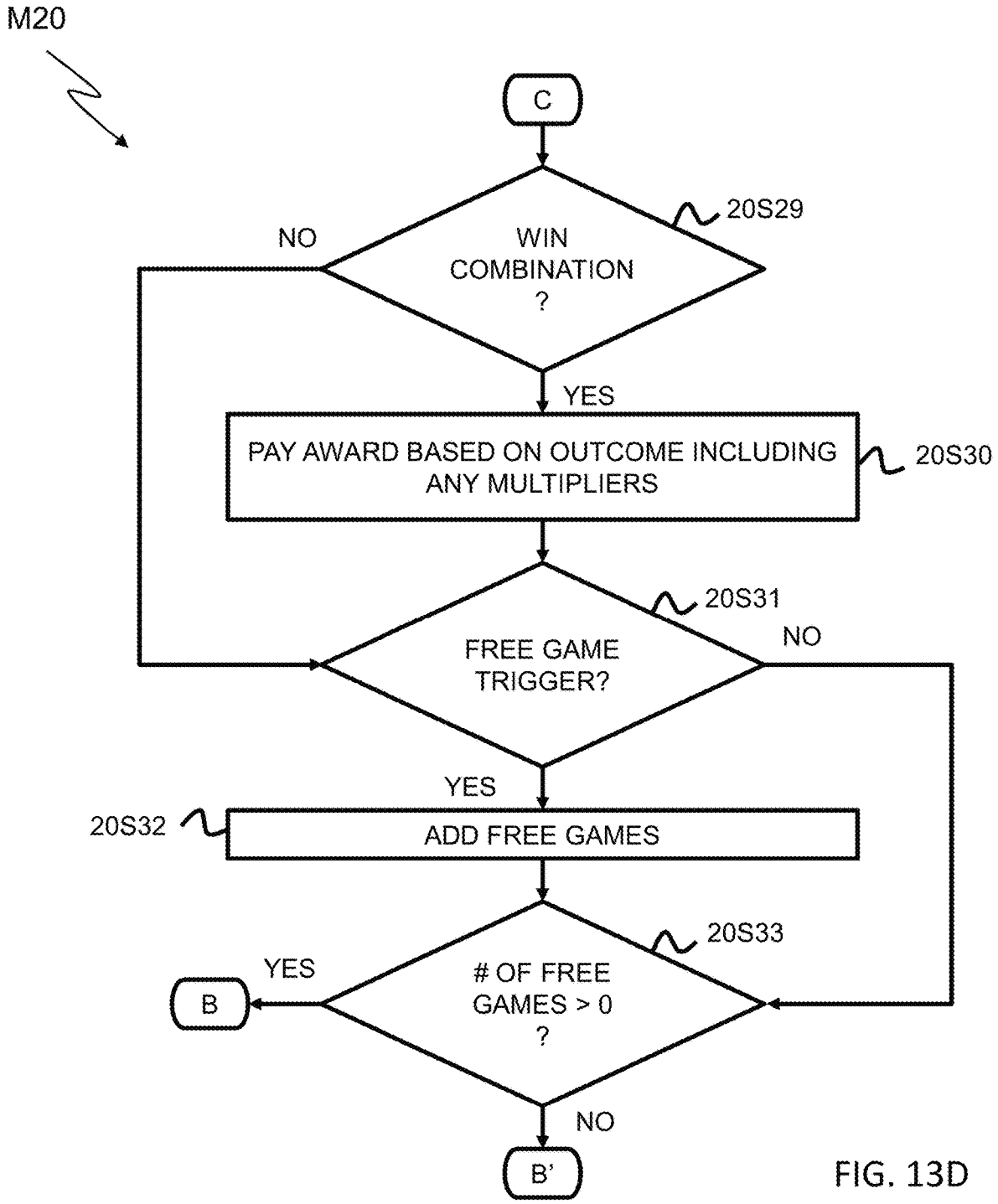

With referent to FIGS. 13C-13D, if the free game feature was triggered in the tenth step 20S10, then starting in the twenty-first step 20S21, a number of free spins are provided. In the illustrated embodiment, the free game feature may be re-triggered during the free spins, i.e., additional free spins may be awarded during the free spins. Additionally, in the illustrated embodiment the multiplier feature is also provided during the free spins.

In the twenty-first step 20S21, one or more of the cells 64 of the grid 60 are randomly determined as candidate cells. In a twenty-second step 20S22, a multiplier is randomly selected for each candidate cell. In one embodiment, the multiplier(s) are randomly selected from a set of predetermined multipliers, e.g., 2×, 3, and 5×.

In one embodiment of the present invention, a different reel strip is used for each candidate cell. For example, in the above embodiment, each cell 64 has an associated reel strip from the set of reel strips including reel strips A, B, C, D, E, F and G. Each reel strip has an associated multiplier reel strip: A', B', C', D', E', F' and G'. The reel strip associated with each cell 64 that has been selected as a candidate cell is changed to the respective multiplier reel strip. It should be noted that the length of, i.e., the number of symbol positions in, the multiplier reel strips may be different than the length, i.e., the number of symbol positions in, the reel strips.

In the twenty-third step 20S23, the reel strip associated with each candidate cell is changed to a respective bonus or multiplier feature reel strip.

In a twenty-fourth 20S24, the method M20 randomly selects a PIC symbol from the second sub-group of symbols. The selected PIC symbol is used in each of the variable symbol position(s) of each of the reel strips and/or multiplier feature reel strips.

In a twenty-fifth step 20S25, a stop position of each of reels is randomly determined. In a twenty-sixth step 20S26, spinning of the reels is initiated.

In one embodiment, the selected multiplier for a candidate cell is applied only if the selected PIC symbol is to be displayed in the outcome of the primary game. Thus, the variable symbol position on each reel strip associated with a reel associated with a candidate cell, the variable symbol position(s) (INN) are replaced with a multiplier symbol associated with the selected multiplier. For instance, if the randomly selected symbol (in the fourteenth step 20S14) is the PIC-D symbol and the selected multiplier for a candidate cell is 2×, then a symbol that includes the PIC-D symbol and the multiplier is placed within each variable symbol position for the respective multiplier feature reel strip in the twenty-seventh step 20S27. As the reel/reel strip rotates through the candidate cell, the modified symbol is displayed.

In a twenty-eight step 20S28, the reels are stopped.

In a twenty-ninth step 20S29, the outcome of the primary game is evaluated and if a win combination exists, then the method M20 proceeds to a thirtieth step 20S30. Otherwise, the method M20 proceeds to a thirty-first step 20531.

In the thirtieth step 20S30, an award is paid to the player based on the outcome of the primary game, any winning combination and a pay table. If the winning combination includes a PIC symbol accompanied by a multiplier, the multiplier is applied. In one embodiment, each multiplier appearing to the outcome is applied only to awards resulting from a winning combination that includes the multiplier. In another embodiment, the multiplier appearing in the outcome are multiplied together and the product is applied to the sum of the award(s) from all winning outcomes.

In the illustrated embodiment, additional free games may be triggered during each free spin. Thus, in the thirty-first step 20531, if the free game trigger is detected (see above), then additional free games may be added to the number of remaining free games in a thirty-second step 20S32. In a thirty-third step 20S33, the number of free games is decremented by one and if the number of free games remaining is greater than zero, then the method M20 returns to the twenty-first step 20S21. The method M20 then ends.

Next, is a description of a program of the gaming machine 10 for operating one or a plurality of computers as the control unit 50. The gaming machine 10 stores the program in the memory, and can execute the program. The gaming machine 10 can access the program stored in the memory and can operate as the gaming machine 10 of the present embodiment by the program.

Further, the program according to the embodiment may be provided through a network or stored in a recording medium. Recording media such as a floppy (registered trademark) disk, CD-ROM, DVD, or ROM and the like, or semiconductor memory and the like are exemplified as a recording medium. In this case, a program stored in the memory uses a reading device inside the gaming machine 10 such as a floppy (registered trademark) disk drive device, CD-ROM drive device, and DVD drive device and the like.

The embodiments of the present invention are described above, but the present invention is not limited to such an embodiment, a variety of variations are possible.

In such an embodiment, a gaming machine 10 providing a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

In one embodiment, referring to FIGS. 1A and 1B, the control panel 26 includes a plurality of user input devices that may include an acceptor device which accepts media associated with a monetary value to establish a credit balance, a validator configured to identify the physical media, a cash-out button actuatable to cause an initiation of a payout associated with the credit balance. The acceptor device may include a touchscreen display associated with the display unit 28 and/or the player tracking unit 57, the paper money/ticket identification unit 42, the operation unit 36, the player tracking unit 57, a coin slot, a ticket in ticket out (TITO) system, a bill acceptor, and/or any suitable device that enables the gaming machine 10 to receive media associated with a monetary value and establish a credit balance for use in playing the gaming machine 10. In one embodiment, the acceptor device may be configured to receive physical media such as, for example, a coin, a medal, a ticket, a card, a boll, currency, and/or any suitable physical media that enables the gaming machine 10 to function as described herein. The acceptor device may also be configured to accept virtual media such as, for example, a player tracking account, a virtual credit balance, reward points, gaming credits, bonus points, and/or any suitable virtual media that enables the gaming machine 10 to function as described herein. For example, in one embodiment, the coin slot may include an opening that is configured to receive coins and/or tokens deposited by the player into the gaming machine 10. The control unit 50 converts a value of the coins and/or tokens to a corresponding amount of gaming credits that are used by the player to wager on games played on the gaming machine 10. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 10. In one embodiment, the bill acceptor also includes a printer (not shown) that is configured to dispense a printed voucher ticket that includes information indicative of an amount of credits and/or money paid out to the player by the gaming machine 10 during a gaming session. The voucher ticket may be used at other gaming devices, or redeemed for cash, and/or other items as part of a casino cashless system.

In the embodiment, determining the stop position of each reel is described as consecutively acquiring a random number that is used respectively, but the acquisition procedure of the random number is not limited to this. For example, when the game starts, the control unit 50 acquires these random numbers in a batch, and each random number may be stored in the storage area of the non-erasing memory 53 or the storage 54 when power failure occurs. In this type of situation, even when a power failure and the like occurs during a game, because the control unit 50 acquired the random number from the memory 53 or the storage 54 when the game started before the power failure occurred, when resuming the game after recovering from a power failure, the progress of the game can be reproduced. For example, when a game result obtaining a high payout is formed right before a power failure occurs, the player will be greatly dissatisfied if the progress of the game is not similar after recovering from a power failure. However, as mentioned above when the game starts all of the random numbers are acquired in a batch, and by saving these random numbers in the memory 53 or the storage 54, such great dissatisfaction can be avoided for the player because the progress of a game similar to before a power failure occurred can be reproduced after recovering from a power failure.

In another embodiment, the player may initiate a game through actuation of a spin button (or other button). After initiation of the game, the control unit 50 randomly determines the step position of all reels. The control unit 50 may perform the check for the trigger condition before the reels stop spinning, and thus has already determined the outcome of the game. However, the control unit 50 displays the outcome of the game in a step by step process as discussed above.

Further, in the embodiment, a bill/ticket is displayed as game value, and received by these bill/ticket identification devices (32, 55), and a form where a ticket is output by a printer unit 34 is described, but the present invention is not limited to this. The game value is a concept including tangible objects such as a coin, bill, coin, medal, ticket, and the like, or electronic data that has a value equivalent to these. For example, a coin is received by the coin accepter, and there may be a form where a coin is paid by a coin hopper. A player is identified and credit that is accumulated in an account on a server is used, there may be a form where credit is paid to an account, information of credit stored in a storage medium of a magnetic card, IC card and the like is read and used, and there may be a form where credit is paid by writing to the storage medium.

Further, in the embodiment when showing a free game provided as a bonus game, a bonus game that uses a different virtual reel strip 71 to 75 from a regular game may be provided. Further, there could be a provided a feature game according to a value of the random number acquired during a regular game.

Further, set conditions providing a bonus or feature game are not limited to trigger determination or line determination, for example there may be a configuration providing a bonus game when the bet number surpasses a predetermined value. There could be a configuration providing a bonus game according to a value of the random number acquired during a regular game.

Further, in the embodiment, a form providing a free game for a predetermined number of times as a bonus game is shown, and a bonus game that is not limited to a number of times may be provided. In this situation, there could be a configuration providing a bonus game until an end condition is satisfied, as an end condition is a combination of specified symbols, or a determining bonus game based on a random number.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine, comprising:

a cabinet;

a display mounted to the cabinet; and a control unit operably coupled to the display, the control unit including a processor programmed to execute an algorithm including the steps of:

displaying a game screen on the display including a plurality of cells arranged in a grid and a plurality of reels displayed within the grid; and conducting an instance of a game by:

randomly selecting one or more cells and associated a multiplier with each randomly selected cell, each multiplier associated with a corresponding feature symbol;

spinning the plurality of reels; and displaying the associated multiplier in a corresponding associated cell as the corresponding feature symbol is rotated through the corresponding associated cell and remove the associated multiplier from the corresponding associated cell when the corresponding feature symbol is rotated out of the corresponding associated cell.

2. The gaming machine of claim 1, wherein the processor is programmed to:

randomly select a set of multipliers from a plurality of sets of multipliers; and randomly associate each multiplier in the selected set of multipliers to one of the cells in the grid.

3. The gaming machine of claim 2, wherein at least two sets of multipliers include a different number of multipliers.

4. The gaming machine of claim 1, wherein the processor is programmed to:

stop the plurality of reels to display an outcome of the game; and determine an award being provided to the player based on multipliers being displayed with the reels in a stopped position.

5. The gaming machine of claim 4, wherein the processor is programmed to:

multiply displayed multipliers together to determine a resultant multiplier; and determine the award being provided to the player based on the resultant multiplier.

6. The gaming machine of claim 1, wherein at least one reel includes a stack of identical feature symbols.

7. The gaming machine of claim 6, wherein the processor is programmed to temporarily display the associated multiplier as the stack of identical feature symbols is rotated through the corresponding associated cell.

8. The gaming machine of claim 1, wherein the processor is programmed to display the plurality of reels including a plurality of independent reels, each independent reel being displayed in a corresponding cell of the grid.

9. A method of operating a gaming machine including a cabinet, a display mounted to the cabinet, and a control unit including a processor operably coupled to the display, the method including the processor performing the algorithm steps of:

displaying a game screen on the display including a plurality of cells arranged in a grid and a plurality of reels displayed within the grid; and conducting an instance of a game by:

randomly selecting one or more cells and associated a multiplier with each randomly selected cell, each multiplier associated with a corresponding feature symbol;

spinning the plurality of reels; and displaying the associated multiplier in a corresponding associated cell as the corresponding feature symbol is rotated through the corresponding associated cell and remove the associated multiplier from the corresponding associated cell when the corresponding feature symbol is rotated out of the corresponding associated cell.

10. The method of claim 9, including the processor performing the algorithm steps of:

randomly selecting a set of multipliers from a plurality of sets of multipliers; and randomly associating each multiplier in the selected set of multipliers to one of the cells in the grid.

11. The method of claim 10, wherein at least two sets of multipliers include a different number of multipliers.

12. The method of claim 9, including the processor performing the algorithm steps of:

stopping the plurality of reels to display an outcome of the game; and determining an award being provided to the player based on multipliers being displayed with the reels in a stopped position.

13. The method of claim 12, including the processor performing the algorithm steps of:

multiplying displayed multipliers together to determine a resultant multiplier; and determining the award being provided to the player based on the resultant multiplier.

14. The method of claim 9, wherein at least one reel includes a stack of identical feature symbols.

15. The method of claim 14, including the processor performing the algorithm steps of:

temporarily displaying the associated multiplier as the stack of identical feature symbols is rotated through the corresponding associated cell.

16. The method of claim 9, including the processor performing the algorithm steps of:

displaying the plurality of reels including a plurality of independent reels, each independent reel being displayed in a corresponding cell of the grid.

17. A non-transitory computer-readable storage media having computer-executable instructions embodied thereon, when executed by at least one processor the computer-executable instructions cause the at least one processor to perform steps of an algorithm including:

displaying a game screen on a display including a plurality of cells arranged in a grid and a plurality of reels displayed within the grid; and conducting an instance of a game by:

randomly selecting one or more cells and associated a multiplier with each randomly selected cell, each multiplier associated with a corresponding feature symbol;

spinning the plurality of reels; and displaying the associated multiplier in a corresponding associated cell as the corresponding feature symbol is rotated through the corresponding associated cell and removing the associated multiplier from the corresponding associated cell when the corresponding feature symbol is rotated out of the corresponding associated cell.

18. The non-transitory computer-readable storage media of claim 17, wherein the computer-executable instructions cause the at least one processor to perform steps of the algorithm including:

randomly selecting a set of multipliers from a plurality of sets of multipliers; and randomly associating each multiplier in the selected set of multipliers to one of the cells in the grid.

19. The non-transitory computer-readable storage media of claim 17, wherein the computer-executable instructions cause the at least one processor to perform steps of the algorithm including:

stopping the plurality of reels to display an outcome of the game;

multiplying displayed multipliers together to determine a resultant multiplier; and determining an award being provided to the player based on the resultant multiplier.

20. The non-transitory computer-readable storage media of claim 17, wherein the computer-executable instructions cause the at least one processor to perform steps of the algorithm including:

displaying at least one reel including a stack of identical feature symbols; and temporarily displaying the associated multiplier as the stack of identical feature symbols is rotated through the corresponding associated cell.

* * * * *